US005997362A

United States Patent [19]

Hatagishi et al.

[11] Patent Number: 5,997,362

[45] Date of Patent: Dec. 7, 1999

[54] CONNECTOR

[75] Inventors: Yuji Hatagishi; Kimihiro Abe, both of Shizuoka-ken; Kouichi Shirouzo, Aichi-ken, all of Japan

[73] Assignee: Yazaki Corporation, Tokyo, Japan

[21] Appl. No.: 09/044,128

[22] Filed: Mar. 19, 1998

[30] Foreign Application Priority Data

Mar. 25, 1997 [JP] Japan ..... 9-072088

[51] Int. Cl.[6] ..... H01R 13/514

[52] U.S. Cl. ..... 439/701; 439/717; 439/752.5

[58] Field of Search ..... 439/701, 712, 439/717, 713, 715, 714, 723, 724, 752, 752.5

[56] References Cited

U.S. PATENT DOCUMENTS

| | | | |
|---|---|---|---|
| 3,363,224 | 1/1968 | Gluntz . | |
| 3,538,489 | 11/1970 | Bennett et al. | 439/701 |
| 5,288,251 | 2/1994 | Sumida | 439/701 |

FOREIGN PATENT DOCUMENTS

| | | | |
|---|---|---|---|
| 5-53154 | 7/1993 | Japan | 439/701 |

*Primary Examiner*—Neil Abrams
*Assistant Examiner*—Eugene G. Byrd
*Attorney, Agent, or Firm*—Finnegan, Henderson, Farabow, Garrett & Dunner, L.L.P.

[57] ABSTRACT

Upper and lower connector housings are respectively formed substantially in a box shape having upper and lower walls. The upper and lower connector housings are connected to each other by overlapping an upper wall of the lower connector housing and a lower wall of the upper connector housing in an opposing state. Engaging holes are respectively formed on the lower wall of the upper connector housing and the upper wall of the lower connector housing. The engaging hole of the upper connector housing is closed by the upper wall of the lower connector housing. The engaging hole of the lower connector housing is closed by the lower wall of the upper connector housing. Accordingly, the terminal can be securely prevented from coming out from the terminal receiving chamber and the adjacent terminals can be securely prevented from being shorted.

19 Claims, 3 Drawing Sheets

CONNECTOR

BACKGROUND OF THE INVENTION

The present invention relates to a connector structured by vertically placing a plurality of connector housings.

A conventional connector of this type is structured by vertically placing connector housings 2 and 3 having flat upper and lower walls and substantially formed in a box shape and connecting to each other (Japanese Utility Model Unexamined Publication No. 5-53154).

A plurality of terminal receiving chambers in which terminals are received are formed in each of the connector housings. A front end and a rear end of each of the terminal receiving chambers are opened. The terminal is inserted into the terminal receiving chamber from the rear end. The terminal of the opposite connector is inserted from the front end of the terminal receiving chamber. An engaging hole open to the upper surface end of the connector housing is formed in the upper wall covering the terminal receiving chamber.

The terminal has a lance on a top surface to which an elasticity is applied by cutting in a rip shape and standing it. When the terminal is received in the terminal receiving chamber, the lance of the terminal is inserted into the engaging hole and becomes an engaging state, so that the terminal is prevented from coming out from the terminal receiving chamber. In this case, in the case of drawing out the terminal from the terminal receiving chamber, a removing jig is inserted into the engaging hole, the lance is pressed by the removing jig, and an engagement between a locking piece and the engaging hole is removed.

However, in the conventional structure mentioned above, a foreign material enters into the engaging hole at a time of manufacturing a wire harness, and the engagement between the lance and the engaging hole is accidentally removed, so that there is a possibility that the terminal comes out from the terminal receiving chamber. Further, in the case that the foreign material has an electrical conductivity, there is a possibility that the adjacent terminals are shorted.

Accordingly, an object of the present invention is to provide a connector which can securely prevent a terminal from coming out from a terminal receiving chamber and prevent adjacent terminals from being shorted.

SUMMARY OF THE INVENTION

In order to achieve the object mentioned above, in accordance with the present invention, there is provided a connector comprising:

first and second connector housings separably overlapped each other and maintained in an overlapped state;

first and second opposing walls respectively provided in the first and second connector housings and opposed to each other in the overlapped state of both connector housings;

first and second receiving chambers respectively provided in the first and second connector housings, each of the receiving chambers receiving a terminal;

a first engaging hole formed in the first opposing wall for providing an opening to the first receiving chamber, the first engaging hole in engagement with the terminal in the first receiving chamber and being closed by the second opposing wall in the overlapped state of both connector housings; and a second engaging hole formed in the second opposing wall for providing an opening to the second receiving chamber, the second engaging hole in engagement with the terminal in the second receiving chamber and being closed by the first opposing wall in the overlapped state of both connector housings.

In this connector, since the first engaging hole is closed by the second opposing wall and the second engaging hole is closed by the first opposing wall, the first and second engaging holes are not opened to an outer portion in the overlapped state of both the connector housings. Accordingly, a foreign material is securely prevented from entering into the engaging holes.

Since the first engaging hole and the second engaging hole are not communicated with each other, the terminals received in the first and second receiving chambers are not brought into contact with each other through the engaging holes.

Accordingly, the terminals are securely prevented from coming out from the receiving chambers by accidentally removing an engagement between the terminal and the engaging hole, and the adjacent terminals are securely prevented from being shorted.

DESCRIPTION OF THE PREFERRED EMBODIMENTS

Figure 1:
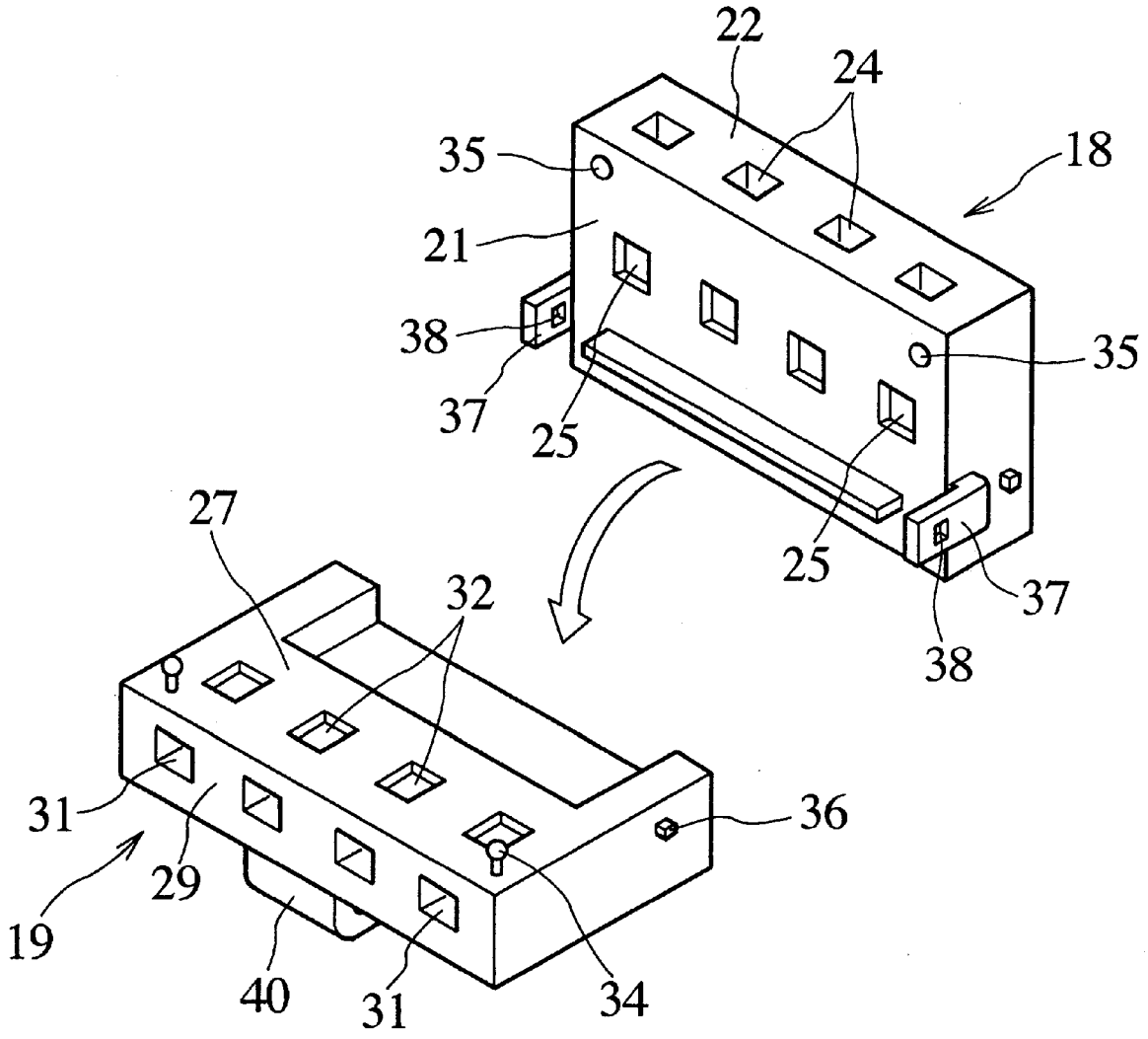
FIG. 1 is a perspective view which shows a relation of a connector housing in accordance with an embodiment of the present invention.

An embodiment of a connector in accordance with the present invention will be described below with reference to the attached drawings. FIG. 1 is a perspective view which shows a relation of a connector housing in a connector in accordance with an embodiment of the present invention, FIG. 2 is an exploded perspective view of the connector, FIG. 3 is a side elevational view of a terminal, and FIG. 4 is a cross sectional view which shows an inner portion of the connector.

Figure 2:
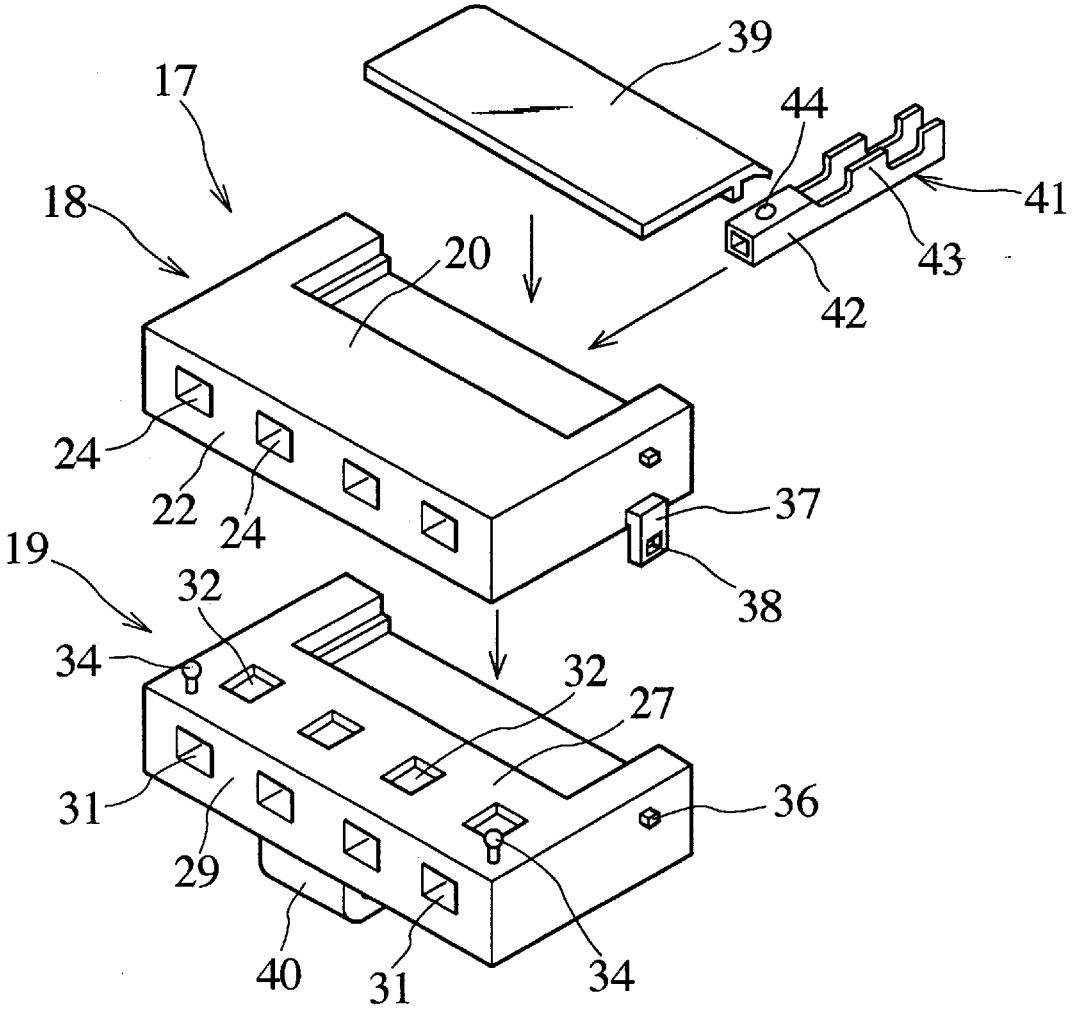
FIG. 2 is an exploded perspective view which shows a connector in accordance with an embodiment.
Figure 3:
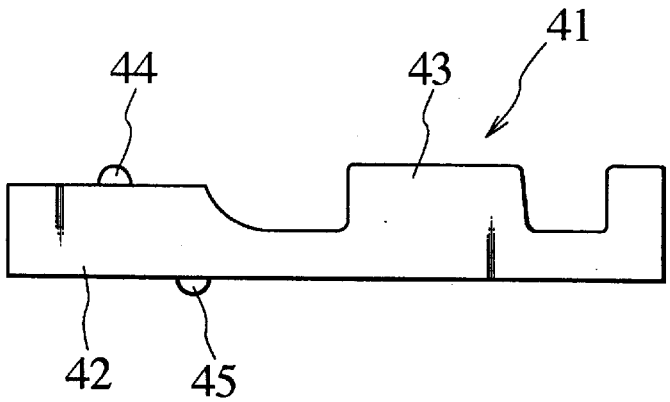
FIG. 3 is a side elevational view of a terminal.
Figure 4:
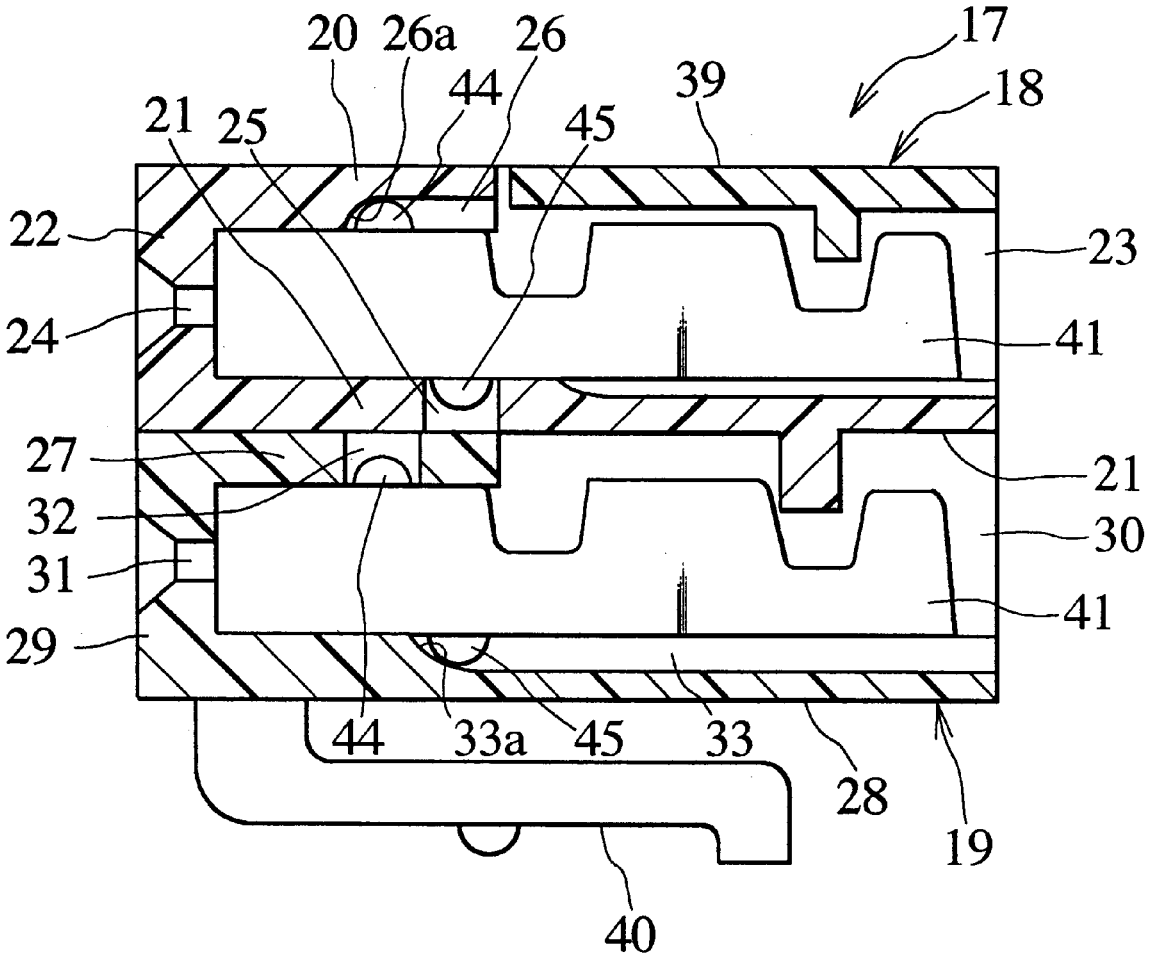
FIG. 4 is a cross sectional view which shows an inner portion of the connector in accordance with an embodiment.

As shown in FIGS. 1, 2 and 4, a connector 17 is constituted by an upper and lower connector housings 18 and 19 which are vertically placed.

The upper connector housing 18 has flat upper and lower walls 20 and 21 and a front end wall 22, and is formed substantially in a box shape having a rear end opened. A plurality of terminal receiving chambers 23 are formed within the connector housing 18 (refer to FIG. 4). A plurality of terminal inserting holes 24 to which the terminals within the opposing connector fitted to the connector 17 are inserted are formed in the front end wall 22 in such a manner as to correspond to each of the terminal receiving chambers 23.

The lower connector housing 19 also has flat upper and lower walls 27 and 28 and a front end wall 29, in the same manner as that in the case of the upper connector housing 18, and is formed substantially in a box shape having a rear end opened. A plurality of terminal receiving chambers 30 are formed within the connector housing 19 (refer to FIG. 4). A plurality of terminal inserting holes 31 to which the terminals within the opposing connector fitted to the connector 11 are inserted are formed in the front end wall 29 in such a manner as to correspond to each of the terminal receiving chambers 30.

The upper and lower connector housings 18 and 19 are overlapped to each other in a state that the lower wall 21 of the upper connector housing 18 and the upper wall 27 of the lower connector housing 19 are opposed to each other. A plurality of engaging holes 25 opening each of the terminal receiving chambers 23 are formed in the lower wall 21 of the upper connector housing 18.

A plurality of engaging holes 32 opening each of the terminal receiving chambers 30 are formed in the upper wall 27 of the lower connector housing 19.

The engaging holes 25 and 32 are formed in the lower wall 21 and the upper wall 27 of each of the housings in such a manner as to be disposed in a relatively shifted position. Accordingly, the engaging hole 25 of the upper connector housing 18 is positioned at the rear of the engaging hole 32 of the lower connector housing 19. Therefore, in a state of overlapping the upper and lower connector housings 18 and 19, the upper wall 27 of the lower connector housing 19 closes the engaging hole 25 of the upper connector housing 19, and the lower wall 21 of the upper connector housing 18 closes the engaging hole 32 of the lower connector housing 32.

As shown in FIGS. 1 and 2, projections 34 and 34 are projected in the upper wall 27 of the lower connector housing 19. The projections 34 and 34 are inserted into hole portions 35 and 35 formed in the lower wall 21 of the upper connector housing 18 so as to be engaged therewith. Lock projections 36 and 36 are provided in both side walls of the lower connector housing 19. The lock projections 36 and 36 are inserted into a lock hole 38 of lock members 37 and 37 downward projected from both the side walls of the upper connector housing 18 so as to be engaged therewith.

The projection 34 and the hole portion 35 serve as a positioning member at a time of overlapping the upper and lower connector housings 18 and 19. The lock projection 36 and the lock member 37 connect the overlapped upper and lower connector housings 18 and 19 to each other.

As shown in FIG. 2, an upper portion of the terminal receiving chamber 23 of the upper connector housing 18 is covered with a cover member 39. As shown in FIG. 4, a lock arm 40 for holding connection between the connector 17 and the corresponding connector is provided in the lower wall 40 of the lower connector housing 19.

As shown in FIGS. 2 and 3, a terminal 41 inserted into the terminal receiving chambers 23 and 30 of the connector housings 18 and 19 so as to be received therein has a contact portion 42 with an opposing terminal disposed in one end, and a connecting portion 43 with an electric wire end portion disposed in the other end.

Indents 44 and 45 corresponding to the engaging portion is formed in the terminal 41. The indents 44 and 45 are formed on both upper and lower surfaces of the contact portion 42 in a protuberant manner and in such a manner as to protrude in a circular arc shape. The upper and lower indents 44 and 45 are formed on the upper and lower surfaces of the contact portion 42 in such a manner as to be longitudinally shifted. More concretely speaking, the indent 44 on the upper surface is positioned in front thereof and the indent 45 on the lower surface is positioned at the back thereof.

As shown in FIG. 4, an engaging groove 26 is formed on the upper wall 20 of the upper connector housing 18. The engaging groove 26 is disposed within each of the terminal receiving chambers 23. A width of the engaging groove 26 is slightly larger than a width of the indent 44 on the upper surface of the terminal 41, and the indent 44 of the upper surface is engaged with the engaging groove 26 in such a manner as to freely move to a longitudinal direction. A front end surface 26*a* of the engaging groove 26 is positioned in front of the engaging hole 25.

An engaging groove 33 is formed on the lower wall 28 of the lower connector housing 19 in the same manner as that of the upper connector housing 18. The engaging groove 33 is disposed within each of the terminal receiving chambers 30. A width of the engaging groove 33 is slightly larger than a width of the indent 45 on the lower surface of the terminal 41, and the indent 45 of the lower surface is engaged with the engaging groove 33 in such a manner as to freely move to a longitudinal direction. A front end surface 33*a* of the engaging groove 33 is positioned at the rear of the engaging hole 32.

In order to place the upper and lower connector housings 18 and 19 and connect them to each other, the lower wall 21 of the upper connector housing 18 is positioned and mounted on the upper wall 27 of the lower connector housing 19. In this state, the upper and lower connector housings 18 and 19 are connected to each other by fitting the projection 34 into the hole portion 35 and fitting the lock projection 36 into the lock hole 38 of the lock member 37.

As shown in FIG. 4, in this state, the engaging hole 25 of the upper connector housing 18 is closed by the upper wall 27 of the lower connector housing 19, and the engaging hole 32 of the lower connector housing 19 is closed by the lower wall 21 of the upper connector housing 18.

Next, the terminal 41 is inserted into the terminal receiving chambers 23 and 30 of each of the connector housings 18 and 19. As shown in FIG. 4, when the terminal 41 is inserted into the terminal receiving chamber 23 of the upper connector housing 18, the indent 44 on the upper surface of the terminal 41 engages with the engaging groove 26, and the indent 45 on the lower surface is engaged with the engaging hole 25. The terminal 41 is received in the terminal receiving chamber 23 in a stable state with no play by an engagement of these indents 44 and 45.

An insertion of the terminal 41 into the terminal receiving chamber 30 of the lower connector housing 19 is performed in the same manner. The indent 45 on the lower surface of the terminal 41 is engaged with the engaging groove 33, and the indent 44 on the upper surface is engaged with the engaging hole 32, so that the terminal 41 is received in the terminal receiving chamber 30 in a stable state with no play.

In the connector 17, in a connecting state between the upper and lower connector housings 18 and 19, since the engaging holes 25 and 32 of the upper and lower connector housings 18 and 19 are closed by the walls 27 and 21 of the opposing connector housings 19 and 18, and the engaging holes 25 and 32 are not opened to the outer portion, no foreign material is inserted into the engaging holes 25 and 32.

In a state of connecting the upper and lower connector housings 18 and 19 to each other, since both of the engaging holes 25 and 32 are not communicated with each other, the terminals 41 within the terminal receiving chambers 23 and 30 are apart from each other.

Even when a tensile stress is acted on the terminal 41, there is no possibility that the indents 44 and 45 enter into the engaging holes 32 and 25 of the opposing connector housings 18 and 19 so as to be in contact with the terminal 41.

Accordingly, it can be securely prevented that an engagement between the terminal 41 and the engaging holes 25 and 32 is accidentally removed so that the terminal 41 comes out from the terminal receiving chambers 23 and 30, and that the vertically adjacent terminals 41 and 41 are shorted.

Further, the engaging holes 25 and 32 are closed only by forming the upper and lower engaging holes 25 and 32 in such a manner as to be longitudinally shifted. Accordingly, no specific structure for closing the engaging holes 25 and 32 is required and the structure is made simple.

In addition, since the indents 44 and 45 of the terminal 41 are formed substantially in a protruded circular arc shape, the indents are not deformed by being caught in the engaging holes 25 and 32 at a time of attaching and detaching the terminal 41. Accordingly, the terminal 41 can be easily drawn out from the connector housings 18 and 19 by inserting the removing jig into the engaging holes 44 and 45.

Here, in this embodiment, the terminals 41 received in two terminal receiving chambers 23 and 30 is set to be the same shape, however, they can be formed in a different shape. Accordingly, the structure may be made such that the engaging grooves 26 and 33 are not provided in the upper and lower connector housings 18 and 19, only the indent 45 on the lower surface is provided on the terminal for the upper terminal receiving chamber 23, and only the indent 44 on the upper surface is provided on the terminal for the lower terminal receiving chamber 30.

Further, three or more connector housings may be overlapped.

What is claimed is:

1. A connector comprising:

first and second connector housings separably overlapped with each other and maintained in an overlapped state;

first and second opposing walls respectively provided in the first and second connector housings and opposed to each other in the overlapped state of the first and second connector housings;

first and second receiving chambers respectively provided in the first and second connector housings, each of the receiving chambers receiving a terminal;

a first engaging hole formed in the first opposing wall for providing an opening to the first receiving chamber, the first engaging hole being in engagement with the terminal in the first receiving chamber and being closed by the second opposing wall in the overlapped state of the first and second connector housings; and a second engaging hole formed in the second opposing wall for providing an opening to the second receiving chamber, the second engaging hole being in engagement with the terminal in the second receiving chamber and being closed by the first opposing wall in the overlapped state of the first and second connector housings.

2. A connector as recited in claim 1, wherein the second engaging hole is deviated from the first engaging hole in the overlapped state of both connector housings.

3. A connector as recited in claim 1, wherein:

the first terminal received in the first receiving chamber has a first engaging portion being in engagement with the first engaging hole; and the second terminal received in the second receiving chamber has a second engaging portion being in engagement with the second engaging hole.

4. A connector as recited in claim 3, wherein the first engaging portion is a first indent opposing the first engaging hole and projecting from a surface of the terminal that is received in the first receiving chamber, and the second engaging portion is a second indent opposing the first engaging hole and projecting from a surface of the terminal that is received in the second receiving chamber.

5. A connector as recited in claim 1, wherein each of the terminals received in the first and second receiving chambers has a first engaging portion being in engagement with the first engaging hole and a second engaging portion being in engagement with the second engagement hole.

6. A connector as recited in claim 5, wherein each of the terminals has two surfaces each facing opposing directions, the first engaging portion is a first indent projecting from one of the two surfaces, and the second engaging portion is a second indent projecting from the other of the two surfaces.

7. A connector as recited in claim 6, wherein the first connector housing has a first groove in which the second indent is received, and the second connector housing has a second groove in which the first indent is received.

8. A connector as recited in claim 1, wherein each of the first and second connector housings is formed substantially in a box shape.

9. A connector as recited in claim 1, wherein at least one of the first and second connector housings has a connecting mechanism for maintaining the overlapped state.

10. A connector housing as recited in claim 6, wherein the first engaging portion comprises a first indent projecting into the first engaging hole from a surface of the terminal when a terminal is received within the first connector housing, the second engaging portion comprises a second indent projecting into the second engaging hole from a surface of the second terminal when a terminal is received within the second connector housing, the engagement between the first engaging portion and the first engaging hole comprises operative contact between the first indent and the first engaging hole when a terminal is received within the first connector housing, and the engagement between the second engaging portion and the second engaging hole comprises operative contact between the second indent and the second engaging hole when a terminal is received within the second connector housing.

11. A connector structure comprising:

a first housing having an upper wall and a lower wall for receiving a first terminal, the lower wall of the first housing having a first housing engaging hole for engaging a first terminal engagement portion of a terminal that is received within the first housing;

a second housing having an upper wall and a lower wall for receiving a second terminal, the upper wall of the second housing having a second housing engaging hole for engaging a second terminal engagement portion of a terminal that is received within the second housing; and wherein the first and second housings are separably overlapped with each other and maintained in an overlapped state, the lower wall of the first housing covers the second housing engaging hole, and the upper wall of the second housing covers the first housing engaging hole.

12. A connector structure as recited in claim 11, wherein the second housing engaging hole is deviated from the first housing engaging hole when the first and second housings are in the overlapped state.

13. A connector structure as recited in claim 11, wherein the first terminal engagement portion comprises a first terminal indent opposing the first housing engaging hole and projecting from a lower surface of the terminal that is received within the first housing:

the second terminal engagement portion comprises a second terminal indent opposing the second housing engaging hole and projecting from an upper surface of the second terminal that is received within the second housing.

14. A connector structure as recited in claim 11, wherein the first terminal engagement portion comprises a first terminal indent projecting into the first housing engaging hole when the terminal is received within the first housing and when the first and second housings are in the overlapped state, and the second terminal engagement portion comprises a second terminal indent projecting into the second housing engaging hole when the terminal is received within the second housing and when the first and second housings are in the overlapped state.

15. A connector structure as recited in claim 11, wherein each of the first and second housings is formed substantially in a box shape.

16. A connector structure as recited in claim 11, wherein at least one of the first and second housings has a connecting mechanism for maintaining the overlapped state.

17. A connector structure comprising:

a first housing having an upper wall and a lower wall for receiving a first terminal, the lower wall of the first housing having a first housing engaging hole for engaging a lower first terminal engagement portion when the first terminal is received within the first housing;

a second housing having an upper wall and a lower wall for receiving a second terminal, the upper wall of the second housing having a second housing engaging hole for engaging an upper second terminal engagement portion of the second terminal when the second terminal is received within the second housing; and wherein the first and second housings are separably overlapped with each other and maintained in an overlapped state, the lower wall of the first housing covers the second housing engaging hole, and the upper wall of the second housing covers the first housing engaging hole.

18. A connector structure as recited in claim 17, wherein the lower first terminal engagement portion comprises a lower first terminal indent projecting into the first housing engaging hole when the first terminal is received within the first housing, and the upper second terminal engagement portion comprises an upper second terminal indent projecting into the second housing engaging hole when the second terminal is received within the second housing.

19. A connector structure as recited in claim 18, wherein the upper wall of the first housing has a first housing groove in which an upper first terminal indent of the first terminal is received when the first terminal is inserted within the first housing, and the lower wall of the second housing has a second housing groove in which a lower second terminal indent of the second terminal is received when the second terminal is inserted within the second housing.

* * * * *